United States Patent [19]

Iantorno

[11] 4,010,539

[45] Mar. 8, 1977

[54] METHOD FOR FABRICATING MULTI-FURCATED ELECTRICAL TERMINALS

[75] Inventor: James Iantorno, Mamaroneck, N.Y.

[73] Assignee: Sealectro Corporation, Mamaroneck, N.Y.

[22] Filed: Mar. 8, 1976

[21] Appl. No.: 664,988

[52] U.S. Cl. ..... 29/630 D; 339/258 A

[51] Int. Cl.[2] ..... H01R 9/00

[58] Field of Search ..... 29/630 D; 339/258

[56] References Cited

UNITED STATES PATENTS

| | | | |
|---|---|---|---|
| 2,807,001 | 9/1957 | Demarkles et al. | 29/630 D |
| 3,122,408 | 2/1964 | Laszczewski | 339/258 A |

FOREIGN PATENTS OR APPLICATIONS

| | | | |
|---|---|---|---|
| 2,325,820 | 12/1974 | Germany | 29/630 D |

*Primary Examiner*—Lowell A. Larson
*Attorney, Agent, or Firm*—Anthony J. Casella

[57] ABSTRACT

A method for producing tri-furcated electrical terminals including a series of parallel extending metal tines unitary with a base portion comprising the steps of first extruding a length of conductive metal to produce a plurality of spaced channels formed in the external surface, and joined by a central axial core. Next, the metal is cut into predetermined lengths to form a plurality of terminal blanks, after which the core of each terminal blank is partially removed by a rotating drill, axially aligned with the terminal to produce a plurality of separate tines supported on an integral base.

1 Claim, 7 Drawing Figures

METHOD FOR FABRICATING MULTI-FURCATED ELECTRICAL TERMINALS

CROSS REFERENCE TO RELATED PATENTS

This invention is related to a terminal device of the type shown and described in U.S. Pat. No. 3,504,107 which issued to J. Iantorno et al. on Mar. 31, 1970, and which is assigned to the same assignee of the subject application, and entitled "INSULATED TWO-PIECE TERMINAL". The subject invention is, in part, an improvement of the invention of said patent, the disclosure of which is incorporated herein by reference.

BACKGROUND OF THE INVENTION

The subject invention relates to a new and improved method of fabricating a multi-furcated electrical terminal, and more particularly a method for fabricating a tri-furcated terminal. Tri-furcated terminals are mainly used in electrical connections where hand soldering operations are performed. The advantage of tri-furcated terminals over bi-furcated terminals lies in the ability of tri-furcated terminals to keep wire strands in a fixed position, without the necessity to twist the wires or strands around the terminal. Prior art methods for fabricating tri-furcated terminals have been costly to perform because of the slotting operations and the attendant positioning of the material during the fabrication process. More particularly, one common method of manufacturing electronic terminals and other components of tri-furcated design is by machining, wherein heavy reliance is placed on the features and accessory options found specifically in automatic screw machines. Initial cost of accessories plus the cost of hiring skilled personnel for setting up such equipment, often dictates that partially completed parts, or blanks be made on a screw machine, while the balance of operations are performed on secondary equipment, often specially tooled. Although sometimes less costly than the former method, orientation difficulties, eccentricity and non-uniformity of cuts are to be expected. Tri-furcated terminals which are employed in electronic circuitry, and which are manufactured under prior techniques, are machined in the usual manner on a stop-spindle machine having indexing capabilities, so as to permit slotting on one end of the part in three places equally spaced to form the tri-furcated lug. As can readily be appreciated, stopping of the spindle and indexing greatly increases the cycle time required to machine each piece, thereby adding to its manufacturing costs.

Accordingly, it is the object of the subject invention to overcome the shortcomings of the prior art, and more particularly to provide a new and improved method for fabricating tri-furcated terminals at greatly reduced costs than heretofore obtained utilizing conventional techniques. In addition, it is an object of the subject invention to provide a new and improved method for fabricating tri-furcated electrical terminals utilizing less complex machinery, and greatly reducing the number of skilled personnel required in the production methods. It is a further object to increase the rate of production of fabricating tri-furcated terminals, while greatly reducing the cost of production. Although throughout the detailed description reference will be made to tri-furcated electrical terminals having three tines, it is evident that the number of tines is not limited to three, but depends on the shape of the extruded wire, which does not necessarily have to be of circular diameter. Other advantages of the subject method of fabrication is obtained from the reduced number of machining operations necessary, particularly the slotting operation employed in the prior art technique which required three separate operations, which of course is extremely expensive. In addition, the subject invention provides a technique wherein the resulting tines of the tri-furcated terminal have sharp edges resulting from the machining step of the subject process, thereby eliminating the need for knurling, as required by prior art techniques. It has also been found that the sharp edges of the tri-furcated terminal made according to the subject method provides excellent grip edges on the tines for connection to the stranded wires to which the terminal is connected.

The subject invention provides a new and improved method for fabricating tri-furcated terminals wherein first a wire, preferably of circular diameter, but which may also have other configurations, is extruded to a shape with a specific periphery, and more particularly containing three equally spaced external grooves of predetermined width and depth extending along the longitudinal axis of the wire. Next, the wire is loaded into a machine, and clamped in a collet, and while in this position the core of the wire material is removed to a limited extent by a drill of appropriate diameter to separate the three tines. The remaining shape is then machined to form a finished electrical part, after extending the material out of the collet.

By employing the subject technique it has been found that any basic turning machine, such as a common screw or moving head stock type machine, may be utilized, and special accessories and cutters are not required. Furthermore, as contrasted to the prior art techniques which employ stopping spindle and indexing devices, the subject invention completely eliminates this apparatus, thereby decreasing the cycle time and simplifying the manufacturing process. As indicated above, knurling and associated problems found in prior art tri-furcated terminals are eliminated by resorting to the manufacturing process of the subject invention, which results in a tri-furcated terminal having uniform, sharp edges on the tines. Still further, the subject invention provides a process where improved concentricity and increased driving force with low clamping pressure is obtained by use of a profile collet which is used to clamp the core of the wire.

In the method for producing electrical terminals according the subject invention, a series of parallel extending metal tines are formed integral with a base by first extruding a length of metal, having a generally circular cross section, to form a plurality of spaced channels in its external surface. The extruded metal is then cut into predetermined lengths and the central core of each length is removed for a specified distance to form the tines which can be used to support an external connecting conductor. If used in an automatic screw machine, the core is removed by drilling before each terminal is cut from the extruded base. More particularly, the terminal may be made by drilling directly into an uncut wire to remove the core, followed by advancement of the wire forward of the collet, followed by machining to the desired shape to form the multifurcation prior to cutting the wire to complete the terminal.

Additional details of the invention will be disclosed in the following description, taken in conjunction with the accompanying drawings in which.

DESCRIPTION OF THE PREFERRED EMBODIMENT

Figure 1:
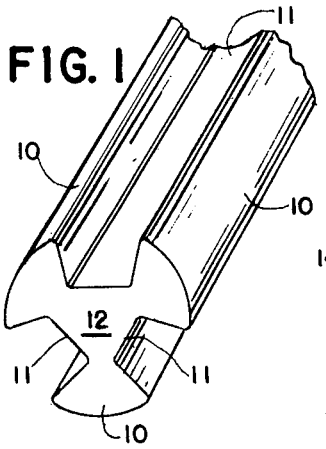
FIG. 1 is an isometric view of the extruded metal base showing the channels and splines.
Figure 2:
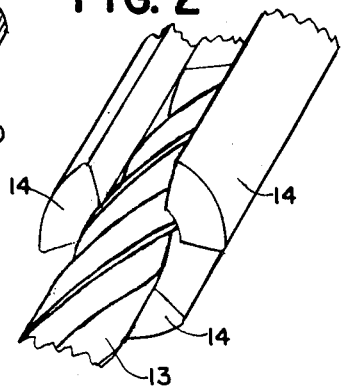
FIG. 2 is an isometric view of the metal base with a twist drill removing a portion of the core, thereby separating the splines.
Figure 3:
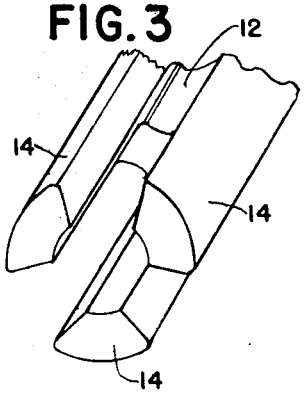
FIG. 3 is another isometric view of the metal base showing the result of the drilling operation.

FIGS. 1, 2, and 3 show a terminal being formed in a sequence of steps according to the subject process. First, a cylindrical wire (not shown) is extruded to form a series of spaced splines 10 separated by channels 11 and connected by a central core 12. This type of extruded article may be formed by rolling, extruding through a multiple die, or extruded through a single die from a reservoir of hot plastic metal. The extruded article is preferrably placed in an automatic screw machine where it is first secured by a collet and then the core 12 is removed for a short distance by an axially positioned drill 13. When the core 12 is removed, the splines 10 are converted into tines 14, each tine equally spaced from its adjoining member. All the figures show three tines, the preferred number, but it is obvious that any number of tines can be created subject only to the limitations of the extruding equipment.

Figure 4:
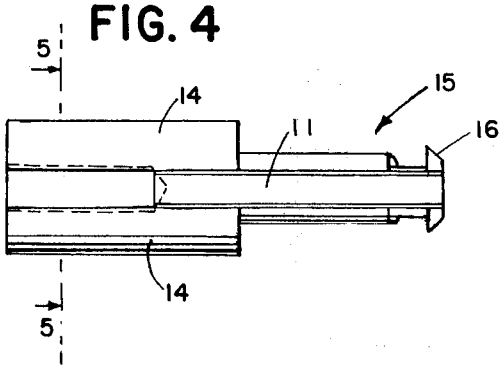
FIG. 4 is a side view of the finished terminal.
Figure 5:
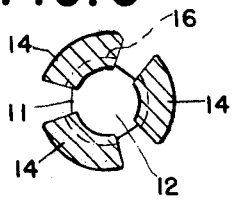
FIG. 5 is a cross sectional view of the terminal shown in FIG. 4 and is taken along line 5—5 of that figure.

If the operations are performed in an automatic screw machine, the extruded article is next moved out of its first or drilling position and material is removed from its base portion to form a spindle 15 as shown in FIG. 4. Then it is cut off from the base article and is ready for use. The spindle 15 may include sharp edged retaining edges 16 or it may include threads for retention by a nut. The means for fastening the terminal to a panel may vary over a wide range of securing devices.

Figure 6:
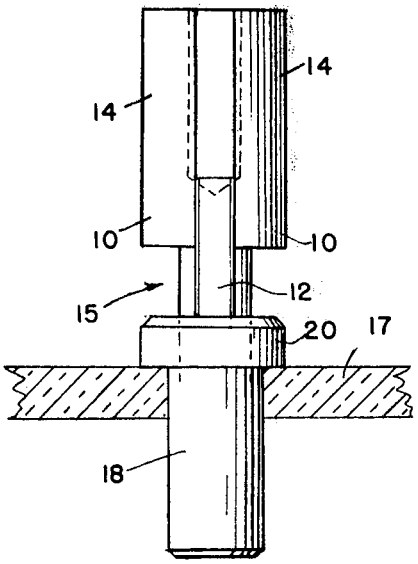
FIG. 6 is a side view of a finished terminal partly engaging a resilient bushing positioned in a panel.
Figure 7:
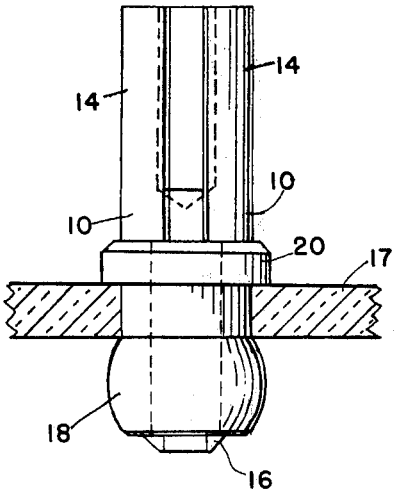
FIG. 7 is a side view of the terminal and bushing shown in FIG. 6 but with the terminal pushed into a fully engaging position, ready for use as a terminal.

FIGS. 6 and 7 show a preferred manner of securing the terminal to a panel 17. A resilient bushing 18, made of rubber or other plastic material is formed with an upper flange 20 and an axial hole which is somewhat smaller than the outside diameter of the spindle 15. The bushing 18 is inserted into the hole in the panel and then the spindle 15 is forced into the bushing 18, producing an enlarged portion of the bushing below the panel (FIG. 7) and thereby providing a fastening means which secures the terminal to the panel. The sharp edges 16 retain the spindle in the grommet as illustrated in FIG. 7

U.S. Pat. No. 3,504,107 describes several means for securing a spindle to a panel by means of a resilient bushing. The present invention can be used with any of these arrangements.

After the terminal has been installed, as indicated in FIG. 7 one or more conductors are pressed into two of the spaces between the tines 14 for electrical contact. The conductors (not shown) may be soldered in place if desired.

While there have been described herein what are at present considered preferred embodiments of the invention, it will be obvious to those skilled in the art that many modifications and changes may be made therein without departing from the spirit and scope of the invention.

What is claimed is:

1. A method for producing an electrical terminal having a series of parallel extending metal tines integral with an insulated bushing comprising the steps of:

extruding a length of metal having a generally circular cross section to form spaced channels in the extruded surface;

fastening the extruded length of metal in a collet in a screw machine;

removing by drilling a portion of the central core to create a plurality of spaced tines on one end of the extruded length of metal, said tines being capable of supporting an external connecting conductor;

removing the extruded length of metal from the collet;

removing material from the opposite end of the extruded length of metal to produce a spindle;

cutting the opposite end from the extruded length of metal; and inserting said opposite end into an insulated bushing to complete the electrical terminal.

* * * * *